US006686698B2

(12) United States Patent
Takeuchi et al.

(10) Patent No.: US 6,686,698 B2
(45) Date of Patent: Feb. 3, 2004

(54) PLASMA DISPLAY APPARATUS

(75) Inventors: Masanori Takeuchi, Kawasaki (JP); Toshio Ueda, Kawasaki (JP); Shigeharu Asao, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 10/291,495

(22) Filed: Nov. 12, 2002

(65) Prior Publication Data

US 2003/0173903 A1 Sep. 18, 2003

(30) Foreign Application Priority Data

Mar. 12, 2002 (JP) ..... 2002-066960
Jul. 18, 2002 (JP) ..... 2002-209950

(51) Int. Cl.[7] ..... G09G 3/10
(52) U.S. Cl. ..... 315/169.2; 313/581; 345/204
(58) Field of Search ..... 315/169.1, 169.2; 313/581, 582, 583, 584, 585; 345/204, 60, 214

(56) References Cited

U.S. PATENT DOCUMENTS 6,037,917 A * 3/2000 Kawakami ..... 345/63
6,100,859 A 8/2000 Kuriyama et al. ..... 345/60
6,104,362 A 8/2000 Kuriyama et al. ..... 345/63
6,317,104 B1 11/2001 Kasahara et al. ..... 345/63
2002/0075206 A1 * 6/2002 Takeda et al. ..... 345/60
2002/0105278 A1 * 8/2002 Kanazawa ..... 315/169.3

FOREIGN PATENT DOCUMENTS

EP 1 139 322 A2 10/2001
JP 9-185343 7/1997
JP 2000-322025 11/2000

OTHER PUBLICATIONS

Database WPI, Section PQ, Week 200169, Derwent Publications Ltd., London, BG; Class P85, AN 2001–606081 XP002244579 & KR 2001 037 391 A (LG Electronics Inc.), May 7, 2001 abstract.
Patent Abstracts of Japan of 9–185343 dated Jul. 15, 1997.

* cited by examiner

*Primary Examiner*—Don Wong
*Assistant Examiner*—Thuy Vinh Tran
(74) *Attorney, Agent, or Firm*—Staas & Halsey LLP

(57) ABSTRACT

A PDP apparatus in which degradation in image quality such as display missing points does not occur, even if the peak luminance is increased, has been disclosed. In the PDP apparatus, the display load ratio of each subfield is detected and a sustain pulse cycle is changed according to the display load ratio of each subfield. Moreover, an adaptive sustain pulse number change means is provided, which calculates the total amount of variations in time by summing the variations in time in a display field caused by the changes in the sustain pulse cycles and increases/decreases the number of sustain pulses of each subfield according to the total amount of variations in time.

10 Claims, 15 Drawing Sheets

| SFL[ ](%) | SFT[ ](μs) |
|---|---|
| 5 | 6.0 |
| 10 | 6.2 |
| 15 | 6.4 |
| 20 | 6.6 |
| ⋮ | ⋮ |
| 85 | 9.4 |
| 90 | 9.6 |
| 95 | 9.8 |
| 100 | 10.0 |

TIM : VACANT TIME
UNIT_T: SUS NUMBER CHANGE UNIT TIME
UNIT_N: SUS NUMBER CHANGE UNIT
SUS : INCREASED SUS NUMBER
TSUS0 : TOTAL SUS NUMBER CALCULATED FROM WEIGHTED AVERAGE LOAD
TSUS : TOTAL INCREASED SUS NUMBER

PLASMA DISPLAY APPARATUS

BACKGROUND OF THE INVENTION

The present invention relates to a plasma display apparatus that provides a gradated display using a subfield method.

The plasma display apparatus (PDP apparatus) has been put into practical use as a flat display and is a thin display of high-luminance. In the PDP apparatus, since it is only possible to control each display cell to be lit or not, a display field is made to consist of plural subfields and the subfields to be lit are combined in each cell to provide a gradated display. Each subfield comprises at least an address period during which a display cell is selected and a sustain period during which the selected cell is lit. In the sustain period, a sustain pulse is applied to cause a sustain discharge to occur, and the luminance is determined by the number of sustain pulses. As a result, if the cycle of the sustain pulse is the same, the luminance is determined by the length of the sustain period. Although the most general and efficient structure of the subfield is that in which the lengths of the sustain periods in the subfields, serially increase and the ratio of the length of the sustain period in a subfield to that of the previous one is 2, various subfield structures have been proposed recently in order to suppress false contours. The present invention can be applied to any PDP apparatus that performs display using any subfield structure.

Moreover, various methods have been proposed for the PDP apparatus, and the present invention can be applied to a PDP apparatus that employs any method. As the structures and the driving methods of the PDP apparatus are widely known, a detailed description is omitted here.

In the PDP apparatus, when the ratio of the cells to be lit to all the cells in the whole screen (display load ratio) is large, a large sustain current flows as a result, and the luminance is degraded because the effective voltage of the sustain pulse is lowered. When the gradated display is performed by the subfield method, a problem is caused that a normal gradated display cannot be performed because the display load ratio differs from subfield to subfield and the luminance ratio of each subfield deviates from a specified relationship. In order to solve the problem, Japanese Unexamined Patent Publication (Kokai) No. 9-185343 has disclosed the structure in which the number of sustain pulses in each subfield is corrected to maintain the luminance ratio by detecting the display load ratio in each subfield.

It is one of the problems relating to the PDP apparatus that the peak luminance is inferior to that of a CRT and the power consumption is large. The power control, therefore, is carried in such a way as to display an image of a lower luminance in total by decreasing the number of sustain pulses in each subfield when the luminance of the entire image is high, and to display an image of a higher luminance in total by increasing the number of sustain pulses in each subfield when the luminance of the entire image is low. As a method of controlling power, Japanese Unexamined Patent Publication (Kokai) No. 2000-322025 has disclosed the method in which the cycle of the sustain pulse is shortened when the luminance level is below a specified value by detecting the average luminance level of the entire screen. By using this method, the peak luminance when an image is dark in total can be improved.

When the cycle of the sustain pulse is shortened, the influence of the distortion of the sustain pulse waveform becomes comparably large and it may happen that the specified sustain voltage is not applied. Particularly, when the display load ratio becomes large, the sustain current increases, and the effective voltage to be actually applied is lowered in accordance with the drop in voltage. FIG.1 is a diagram that shows the relationship between the display load ratio and the effective sustain voltage when a pulse of a specified voltage is applied in accordance with the display load ratio for the sustain pulse cycles 6 $\mu$S, 8 $\mu$S, and 10 $\mu$S. If the effective voltage drops, a problem occurs in that the sustain discharge is not caused to occur or the discharge is terminated on the way, resulting in the generation of missing points, or light emission to achieve a normal luminance is not carried out. In the structure disclosed in Japanese Unexamined Patent Publication (Kokai) No. 2000-322025, the sustain pulse cycle is shortened when the luminance level is low, that is, the display load ratio is small, and the control shown by a short dashed line A in FIG.1 is carried out as a result.

The actual problem, however, is the display load ratio in each subfield when the gradated expression is performed by the subfield method. For example, when the display load ratio in a subfield with a large luminance ratio is very small but that in a subfield with a small luminance ratio is large, the average luminance level (display load ratio) of the entire screen becomes small, and the sustain pulse cycle needs to be shortened according to Japanese Unexamined Patent Publication (Kokai) No. 2000-322025. As a result, the sustain pulse cycle is shortened even in the subfield that has a large display load ratio but a small luminance ratio, and a problem occurs in that such as missing points are generated.

SUMMARY OF THE INVENTION

The objective of the present invention is to realize a PDP apparatus in which degradated image such as the generation of missing display points is not caused even though the peak luminance is increased.

In order to realize the above-mentioned objective, the display load ratio of each subfield is detected and the sustain pulse cycle is changed according to the display load ratio of each subfield in the PDP apparatus of the present invention. If, however, the sustain period of each subfield is fixed, the luminance ratio is changed as a result when the sustain pulse cycle of partial subfields is changed. In the present invention, therefore, an adaptive sustain pulse number changing means is provided to increase/decrease the number of sustain pulses in each subfield according to the total amount of variations in time, which is obtained by summing each variation in time caused by the change in the sustain pulse cycle in a display field.

FIG. 2 is a diagram that illustrates the principles of the present invention. As shown schematically, a display field is composed of four subfields SF1 to SF4. Before the sustain pulse cycle is changed, the sustain pulse cycle of every subfield is 8 $\mu$S, the sustain periods of SF1 to SF4 are, 80 $\mu$S, 160 $\mu$S, 320 $\mu$S, and 640 $\mu$S, and the numbers of sustain pulses of SF1 to SF4 are 10, 20, 40, and 80.

When the display load ratios of SF3 and SF4 are below a specified value, the sustain pulse cycles are changed to 6 $\mu$S. In this case, if the duty ratio is fixed, the pulse width will change with the same ratio. If the numbers of sustain pulses of SF3 and SF4 are maintained to 40 and 80, vacant periods of 80 $\mu$S and 160 $\mu$S are generated in SF3 and SF4, respectively, as a result. Then, with the sustain pulse cycles of SF1 and SF2 being maintained at 8 $\mu$S and those of SF3 and SF4 being maintained at 6 $\mu$S, the numbers of sustain pulses in SF1 to SF4 are adjusted to 12, 24, 48, and 96, respectively. In this way, the total number of sustain pulses increases from 150 to 180, resulting in the improvement of the peak luminance, while the luminance ratio of each subfield is maintained in the specified relationship. In order to increase the number of sustain pulses in each subfield while maintaining the luminance ratio of each subfield, a vacant time of 96 $\mu$S or longer is required, but the vacant time of 48 $\mu$S shown schematically is less than the required time and it remains a vacant period. The sustain pulse cycles of SF1 and SF2, the display load ratio of which is large, remain 8 $\mu$S, resulting in the generation of no missing points, and although the sustain cycles of SF3 and SF4 become 6 $\mu$S, no missing point is generated similarly because of a low display load ratio.

It is also possible to make the sustain discharge stable by, on the contrary expanding the sustain pulse cycle of a subfield when the display load ratio is larger than the specified value. Particularly in the PDP apparatus, the control of power consumption is generally carried out and the total number of sustain pulses is reduced because the power consumption becomes too much when the total number of light emission pulses increases. In this case, a vacant time is generated in a frame, as a result. In this case, therefore it is preferable to make the sustain discharge stable by expanding the sustain pulse cycle. The sustain pulse cycle changing means, therefore, shortens the sustain pulse cycle of each subfield if the display load ratio is lower than the specified value and expands it when higher than the specified value. Although it is possible to treat all the subfields as an object of the frequency modification, it is also possible to treat only partial subfields, that include the one with the maximum luminance, as an object.

The adaptive sustain pulse number changing means increases/decreases the number of sustain pulses so as to maintain the luminance ratio of each subfield.

In addition, as the effective sustain voltage changes and the luminance changes if the sustain pulse cycle is changed, as shown in FIG. 1, it is preferable that an additional adaptive luminance correcting means is provided to correct the change in the luminance due to the change of the sustain pulse cycle, and that the adaptive sustain pulse number changing means increases/decreases the number of sustain pulses of each subfield according to the corrected result.

Moreover, the effective sustain voltage changes depending on the display load ratio of each subfield, therefore, it is preferable to correct the change accordingly and the adaptive sustain pulse number changing means increases/decreases the number of sustain pulses of each subfield.

When the sustain pulse cycle is changed, a large change in display is caused if the cycle is changed considerably, therefore, it is preferable that a change is carried out step by step over plural display subfields so that such a change is not noticed. Moreover, it is preferable that a change is carried out step by step over plural display subfields when the sustain pulse is changed according to the change of the sustain pulse cycle.

When the display load ratio of all the subfields or those that have a specified or higher luminance is lower than a specified value, the control will be easier if the sustain pulse cycle of all the subfields or part of subfields that include the one with the maximum luminance is made identical to each another.

BRIEF DESCRIPTION OF THE DRAWINGS

The features and advantages of the present invention will be more clearly understood from the following description taken in conjunction with the accompanying drawings, in which.

DESCRIPTION OF THE PREFERRED EMBODIMENTS

Figure 3:
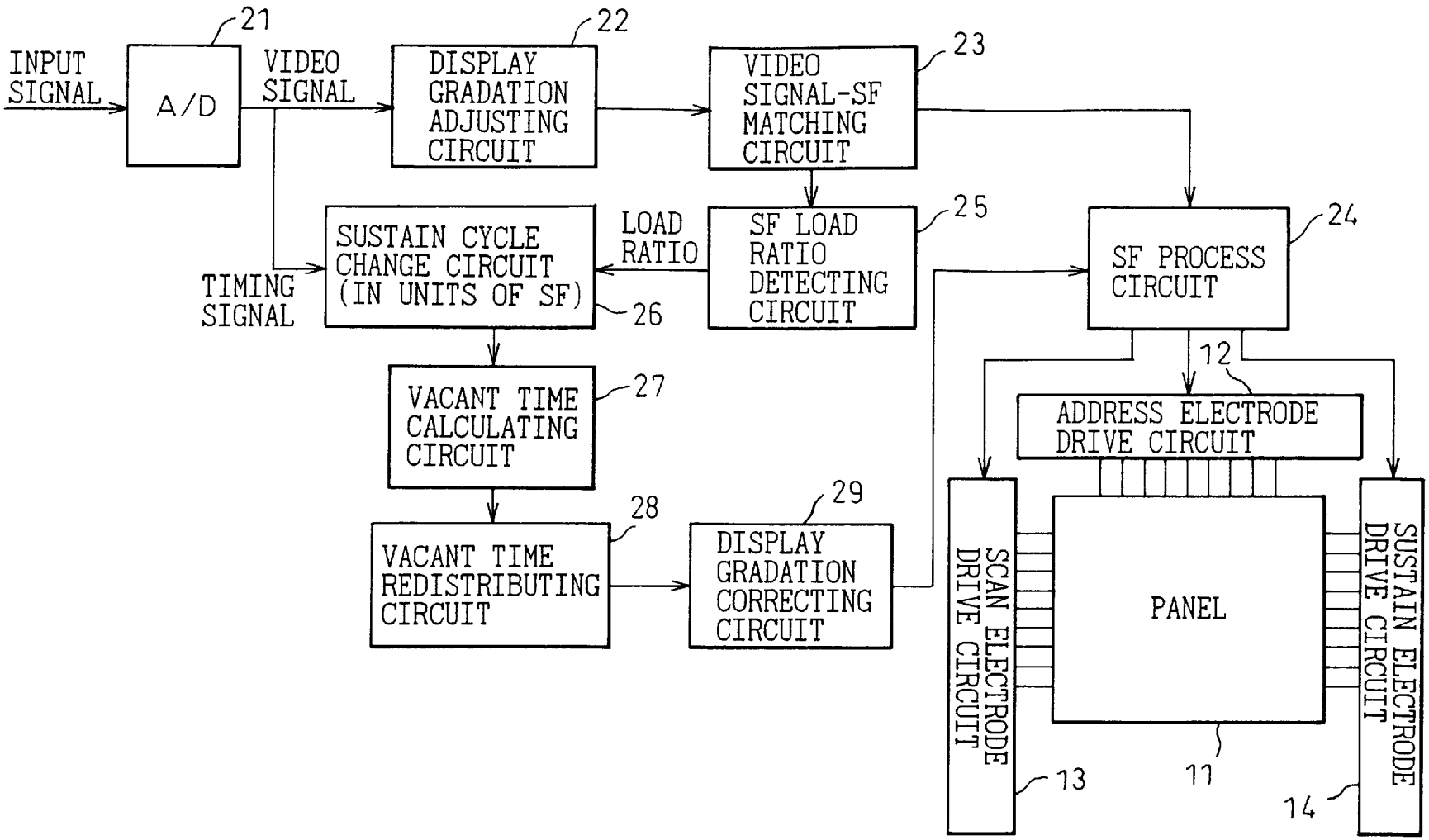
FIG. 3 is a block diagram that shows the rough structure of the PDP apparatus in the first embodiment of the present invention.

FIG. 3 is a block diagram that shows the rough structure of the PDP apparatus in the first embodiment of the present invention. As shown schematically, the PDP apparatus comprises a plasma display panel 11, an address electrode drive circuit 12 that puts out a signal to drive the address electrode of the panel 11, a scan electrode drive circuit 113 that puts out a scan pulse to be applied sequentially to a scan electrode (Y electrode) and a reset pulse and a sustain pulse, a sustain electrode drive circuit 14 that puts out a reset pulse and a sustain pulse to be applied to a sustain electrode (X electrode), an A/D conversion circuit 21 that generates a timing signal as well as converting a video input signal into a digital signal, a display gradation adjusting circuit 22 that adjusts the number of gradations of a video signal by processes such as dithering and error diffusion, a video signal-SF matching circuit 23 that determines the combination of the lit subfields to perform the gradated display for each cell by expanding the adjusted video digital signal, and an SF process circuit 24 that generates a drive signal for subfield display, and the drive signal is supplied from the SF process circuit 24 to the address electrode drive circuit 12, the scan electrode drive circuit 13, and the sustain electrode drive circuit 14. Since the above-mentioned structure is the same as that of the conventional PDP apparatus of the prior art, a detailed description of the waveforms, and so on, is omitted here.

The PDP apparatus in the first embodiment comprises an SF load ratio detecting circuit 25 that detects the display load ratio of each subfield, a sustain cycle change circuit 26 that changes the sustain pulse cycle of each subfield according to the detected display load ratio of each subfield, a vacant time calculating circuit 27 that calculates the variations in the vacant time when the sustain pulse cycle is changed, a vacant time redistributing circuit 28 that redistributes the calculated vacant time in proportion to the product of the luminance ratio of each subfield and the sustain pulse cycle, and a display gradation correcting circuit 29 that allocates the sustain pulse to the distributed time in such a way as to increase or decrease over plural fields in order to maintain the continuity of the luminance. The vacant time calculating circuit 27 and the vacant time redistributing circuit 28 correspond to the adaptive sustain pulse number changing means.

Figure 4:
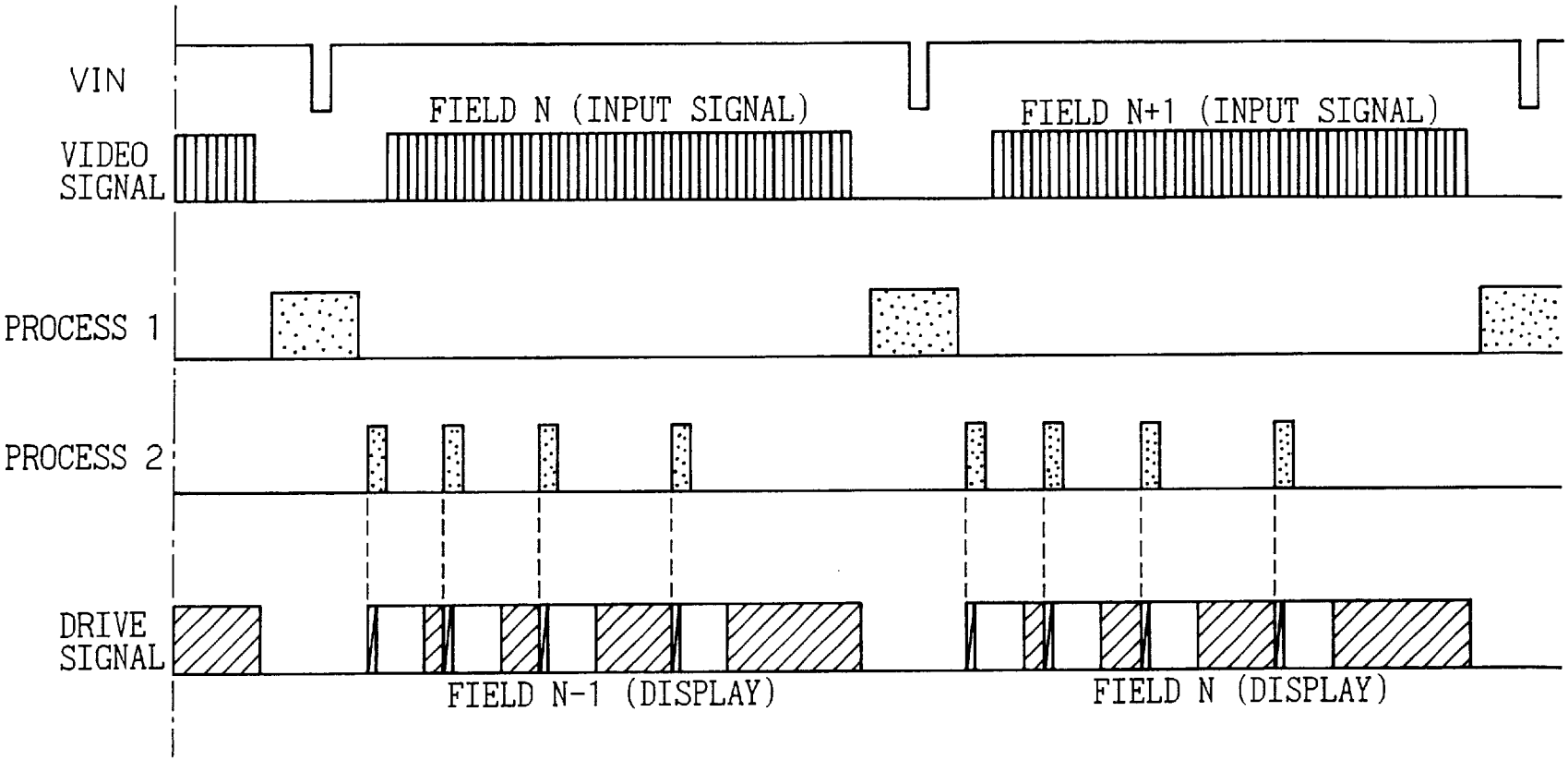
FIG. 4 is a diagram that illustrates the process in the first embodiment.

FIG. 4 is a diagram that illustrates the relationship between the video signal and the processes in the first embodiment. As shown schematically, there is a vertical synchronization signal VIN at the top of a display field, which detects the start of each display field. After the vertical synchronization signal VIN, the video signal is input. After all the video signals of each field are input, a process 1 is carried out by the time the input of the video signal of the next field is started. Subsequently, in synchronization with the start of each subfield, a process 2 is executed and a display is performed by the generation of the drive signal for each subfield.

Figure 5:
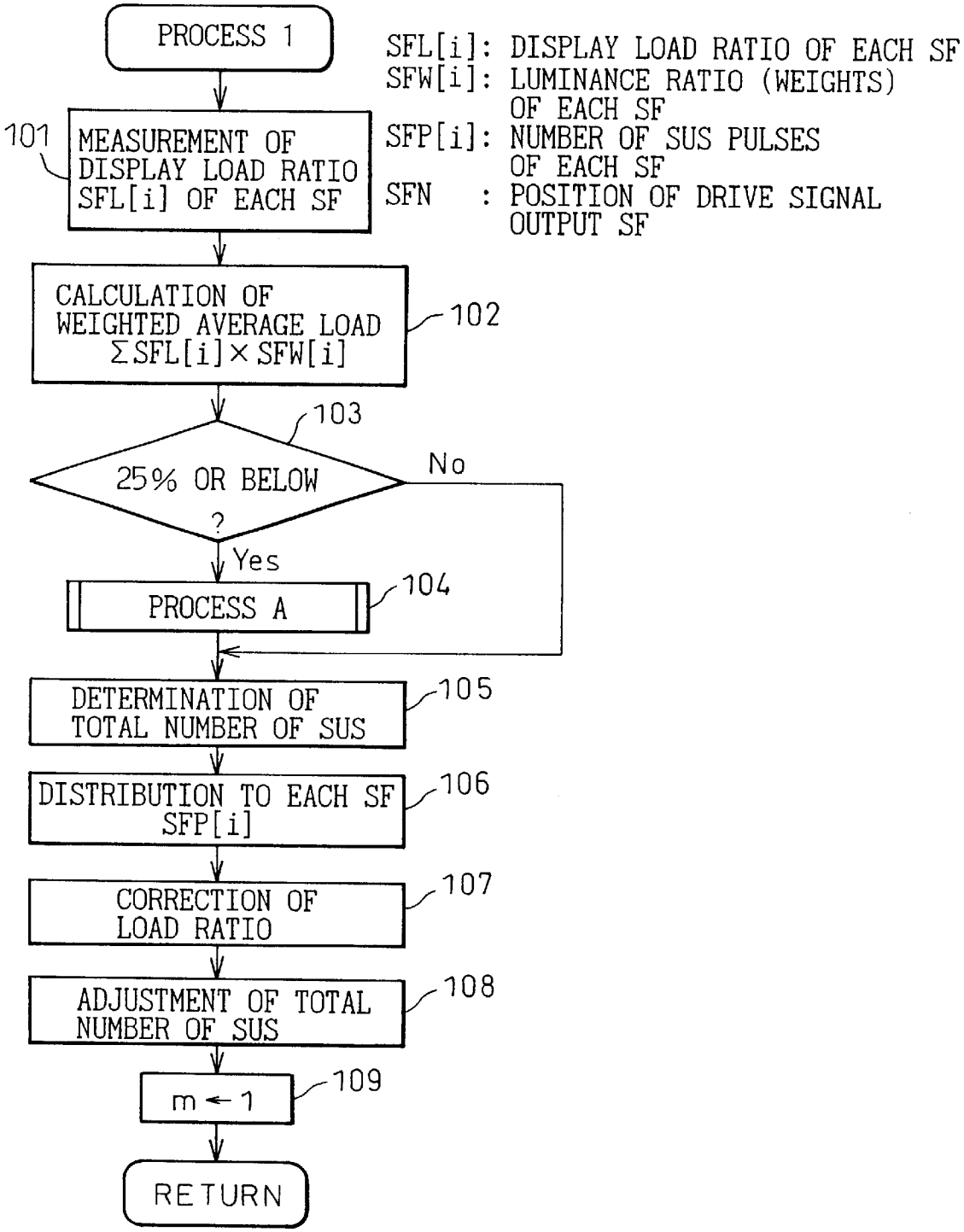
FIG. 5 is a flow chart that shows the process in the first embodiment.
Figure 6:
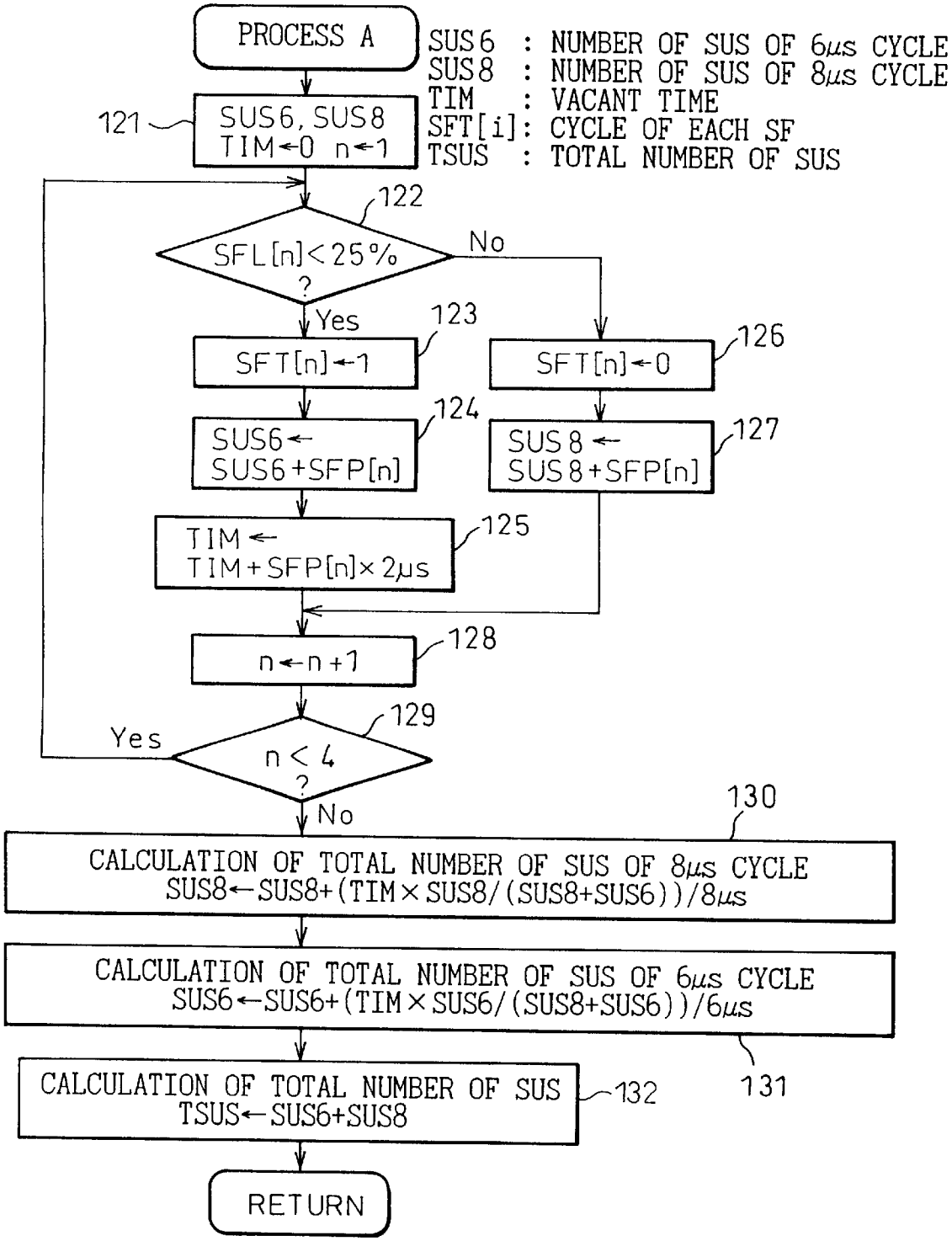
FIG. 6 is a flow chart that shows the process in the first embodiment.

FIG. 5 is a flow chart of the process 1 and FIG. 6 is a flow chart that shows a process A executed in the process 1.

In step 101, the display load ratio SFL [i] of each subfield SF is measured. In step 102, all the products of the display load ratio SFL [i] of each subfield and the luminance ratio SFW [i] of each subfield are summed for every subfield to calculate the weighted average load. The processes in step 101 and step 102 are performed by an SF load ratio detecting circuit 25.

In step 103, it is judged whether the weighted average load is less than 25%, and when equal to or greater than 25%, the flow advances to step 105 and the process is performed as normal, and the flow advances to step 104 and the process A is performed when it is less than 25%. The processes in step 103 and step 104 are performed by a sustain cycle change circuit 26 and a vacant time calculating circuit 27. The process A is described below with reference to FIG. 6.

In step 121, the number of sustain pulses of 6 μS, SUS6, and that of 8 μS, SUS8, and the vacant time TIM are initialized to zero and the number of subfields n is set to 1. In step 122, when the display load ratio SFL [n] of each subfield measured in step 101 is less than 25%, the flow advances to step 123 and when equal to or greater than 25%, the flow advances to step 126.

In step 123, 1, which represents 6 μS, is entered into SFT [n] that indicates the sustain pulse cycle. In step 124, SUS 6 is increased by the number of sustain pulses SFP [n] of the subfield. When the sustain pulse cycle changes from 8 μS to 6 μS, the vacant time SFP [n]×2 μS is generated, therefore, TIM is increased by the corresponding amount in step 125. Then, the flow advances to step 128.

In step 126, on the other hand, 0, which represents 8 μS, is entered into SFT [n] that indicates the sustain pulse cycle. In step 127, SUS 8 is increased by the number of sustain pulses SFP [n] of the subfield. As no vacant time is generated in this case, the flow advances to step 128.

In step 128, the number of subfields n is increased by one, and in step 129, it is judged whether steps 122 to 128 are completed for all the subfields and if not, the flow returns to step 122 and if completed, the flow advances to step 130.

In steps 130 and 131, the vacant time TIM is divided in the ratio of the number of sustain pulses of 8 μS SUS 8 to the number of sustain pulses of 6 μS SUS 6, and the final number of sustain pulses of 8 μS SUS 8 and the final number of sustain pulses of 6 μS SUS are obtained by calculating the increases in SUS 8 and SUS 6. In step 132, the total number of sustain pulses SUS is obtained by summing SUS 8 and SUS 6. Then, the flow goes back to step 105 in FIG. 5.

In step 105, SUS obtained in step 132 is determined as the total number of sustain pulses. In step 106, the total number of sustain pulses SUS is distributed to each subfield and the number of sustain pulses SFP [i] of each subfield is obtained. The process in step 106 is performed by a vacant time redistributing circuit 28.

In step 107, since the luminance is lowered due to drop in voltage according to the display load ratio, the corresponding amount is corrected. Simultaneously, the variations in luminance due to the change in the effective voltage caused by the change of the sustain pulse cycle is corrected. In step 108, it is adjusted so that the change is performed step by step across plural fields when the number of sustain pulses is changed. When the total number of sustain pulses is increased, for example, from 150 to 180, a change is made across three subfields step by step in a manner in which the total number of sustain pulses is changed to 160 in the next field, that is changed to 170 in the second next field, and that is changed to 180 in the third next field. The processes in step 107 and step 108 are performed by a display gradation correcting circuit 29.

In step 109, the initial value 1 is entered in the sign m that indicates a subfield to be displayed, and the process 1 is completed.

Figure 7:
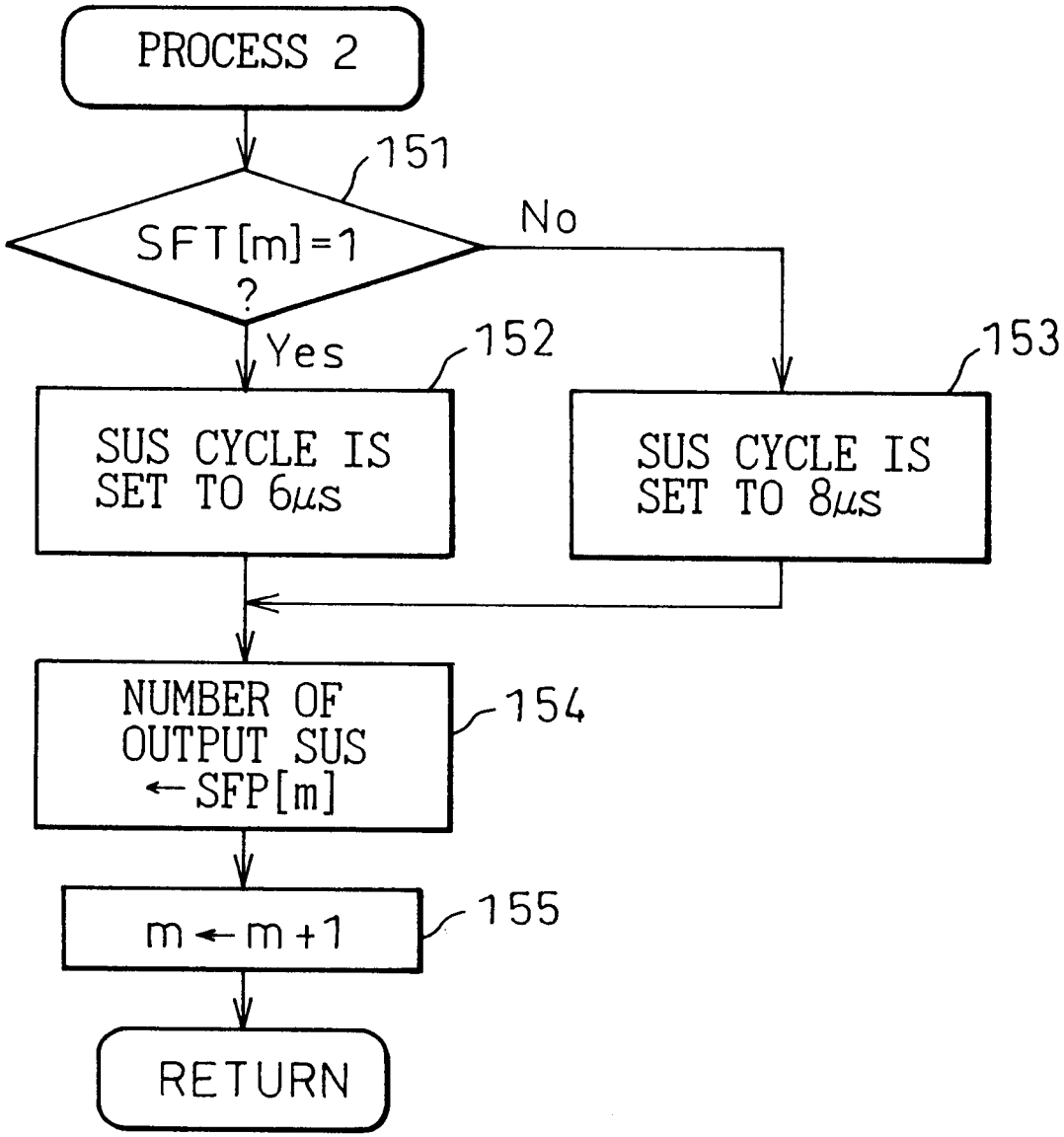
FIG. 7 is a flow chart that shows the process in the first embodiment.

FIG. 7 is a flow chart that shows the process 2.

In step 151, the value of SFT [m] that indicates the sustain pulse cycle is judged, and if it is judged to be 1, which corresponds to 6 μS, the flow advances to step 152, and if it is judged to be 0, which corresponds to 8 μS, the flow advances to step 153. In step 152, the sustain pulse cycle is set to 6 μS, and it is set to 8 μS in step 153.

In step 154, the sustain pulse SFP [m] of the subfield, which is obtained in step 106 and adjusted in steps 107 and 108, is read and the number of sustain pulses to be applied is set to the part to be controlled. In step 155, m is increased by one for completion.

The process 2 is performed in synchronization with each subfield, as described above.

Although only the two levels of 8 μS and 6 μS are used for the sustain pulse cycle in the first embodiment, it is possible to provide more levels so that, for example, the normal level is 8 μS, is changed to 6 μS when the display load ratio is low, and changed to 10 μS when the display load ratio is large.

Although the sustain pulse cycle is changed from 8 μS to 6 μS and the total number of sustain pulses is adjusted so as to increase step by step in the first embodiment, it is also possible to change the sustain pulse cycle from 8 μS to 6 μS across plural fields step by step in such a way as to change to 7.5 μS in the next field, to 7.0 μS in the second next field, to 6.5 μS in the third next field, and it is changed to 6.0 μS in the fourth field.

Moreover, although the object to be changed according to the display load ratio is the sustain pulse cycle of all the subfields, it is also preferable that the object to be changed is the sustain pulse cycle of the subfields, the luminance of which is higher than a specified one and which includes one with the maximum luminance, because a longer vacant time is generated when the sustain pulse cycle is shortened in the subfields the luminance ratio of which is high. In this case, the increment in the number of sustain pulses due to the vacant time can be redistributed to all the subfields or to the partial subfields, the luminance of which is higher than a specified one and which include one with the maximum luminance. By restricting the object, the sustain pulse cycle of which is to be changed, the amount of operations can be reduced.

Moreover, although the display load ratio of each subfield is judged, respectively, and when it is judged to be low, the total number of sustain pulses is calculated after the sustain pulse cycle of each subfield and the number of sustain pulses are calculated, it is also possible to shorten the sustain pulse cycle of all the subfields if the display load ratio of all the subfields is judged first and it is found that each one is less than a specified value. In this case, all that is required is to simply multiply the number of sustain pulses of each subfield by the ratio of the sustain pulse cycles before and after the change, resulting in an easy operation. Also in this case, if the object the sustain pulse cycle of which is to be changed is restricted to that of the subfields, the luminance ratio of which is greater than a specified one and which include one with the maximum luminance, the amount of operations can be further reduced.

Figure 8:
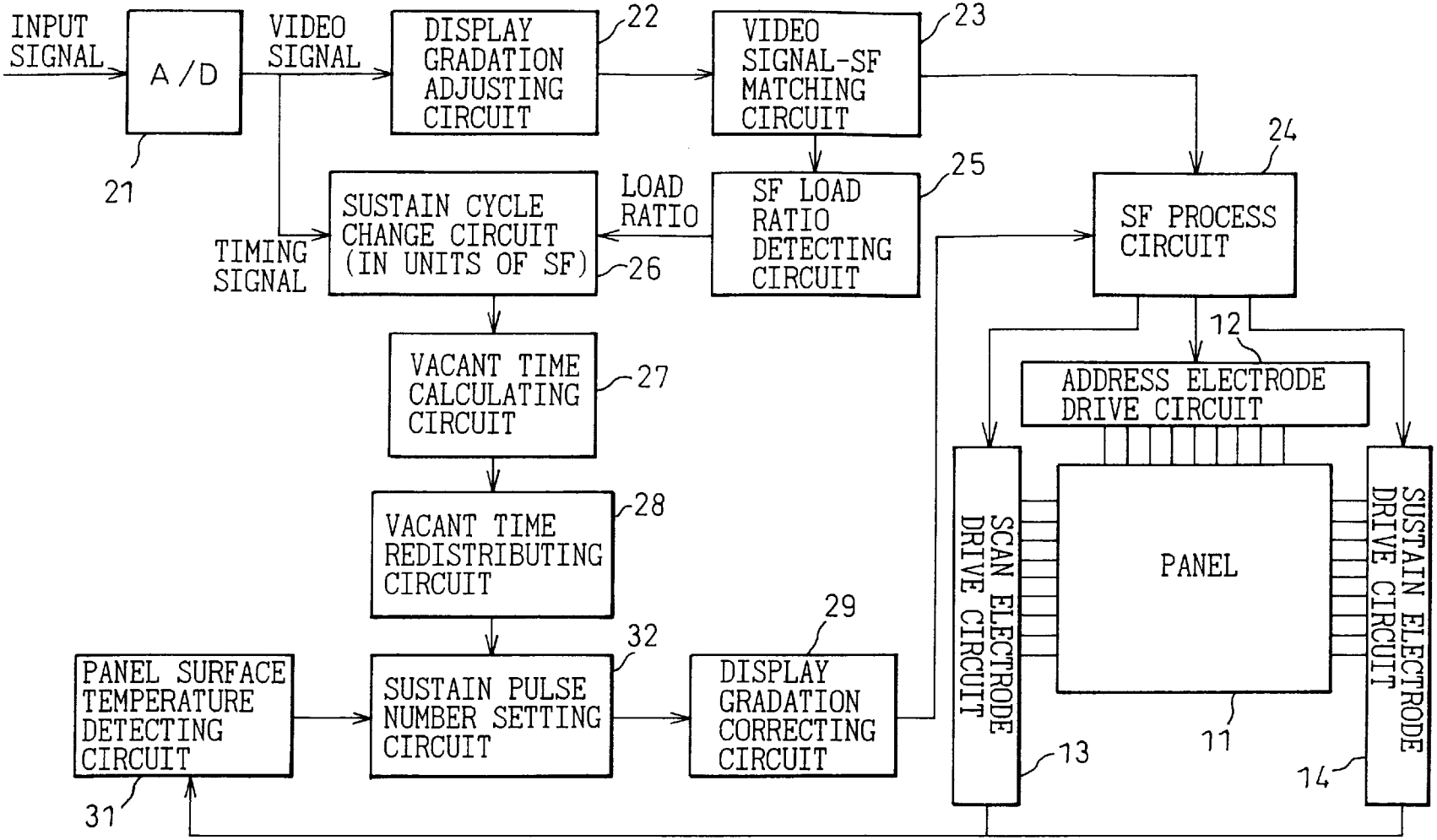
FIG. 8 is a block diagram that shows the rough structure of the PDP apparatus in the second embodiment of the present invention.

FIG. 8 is a block diagram that shows the rough structure of the PDP apparatus in the second embodiment of the present invention. As obvious by comparison with FIG. 3, it differs from the PDP apparatus in the first embodiment in that a panel surface temperature detecting circuit 31 and a sustain pulse number setting circuit 32 are added. By increasing the number of sustain pulses, the temperature of the lit region of the panel 11 rises and it may happen that the panel 11 is damaged if the difference in temperature between the lit region and the non-lit region becomes too large. In order to avoid this, in the second embodiment, the rise in temperature is monitored by the panel surface temperature detecting circuit 31 and the sustain pulse number setting circuit 32 suppresses the increase in the number of sustain pulses to reduce the rise in temperature when a rise in temperature greater than a specified value is detected.

Figure 9:
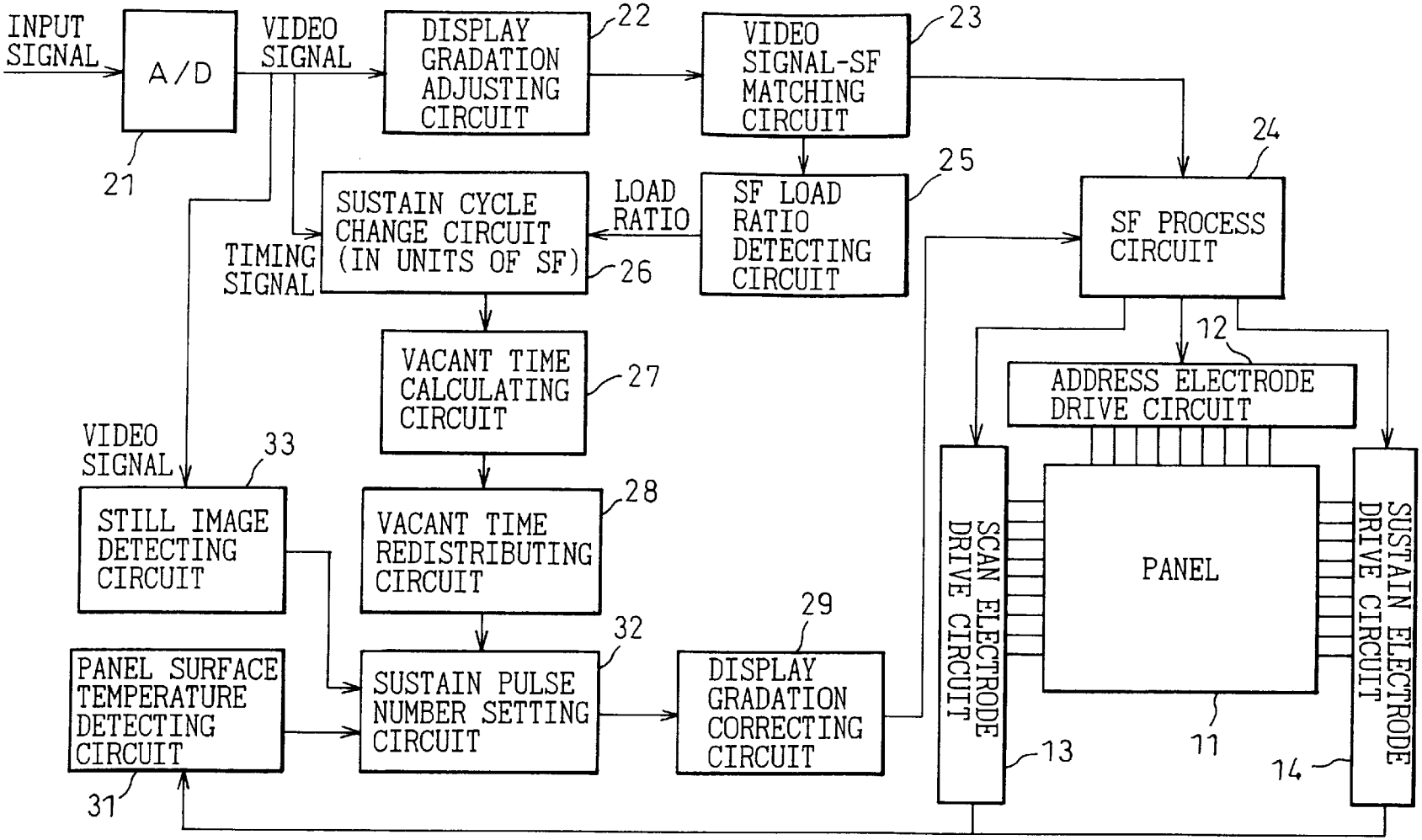
FIG. 9 is a block diagram that shows the rough structure of the PDP apparatus in the third embodiment of the present invention.

FIG. 9 is a block diagram that shows the rough structure of the PDP apparatus in the third embodiment of the present invention. As is obvious from comparison with FIG. 8, it differs from the PDP apparatus in the second embodiment in that a still image detecting circuit 33 is added. Damage to the panel due to a rise in temperature of the panel is caused by the difference in temperature between the lit region and non-lit region. In the case of motion video, it is unlikely that the difference in temperature occurs locally because the lit region and the non-lit region are not fixed and, in the case of still image, the difference in temperature is apt to occur locally. In the PDP apparatus of the third embodiment, therefore, when the still image detecting circuit 33 detects a still image, it notifies the sustain pulse number setting circuit 32 of the fact. The sustain pulse number setting circuit 32 suppresses the increase in the number of sustain pulses when the image is still and the surface temperature of the panel is high.

In the first to third embodiments described above, examples in which the number of sustain pulses is increased by shortening the sustain pulse cycle are described, but it may be the case where it is preferable that a stable discharge is achieved by expanding, not shortening, the sustain pulse cycle when the display load ratio is large. In the fourth embodiment described below, an example is described in which the sustain pulse cycle is shortened in a certain subfield and it is expanded in another subfield.

The PDP apparatus in the fourth embodiment of the present invention has a structure similar to that in the first embodiment shown in FIG. 3, wherein the same process shown in FIG. 4 is carried out, but the contents of the process are different.

Figure 10:
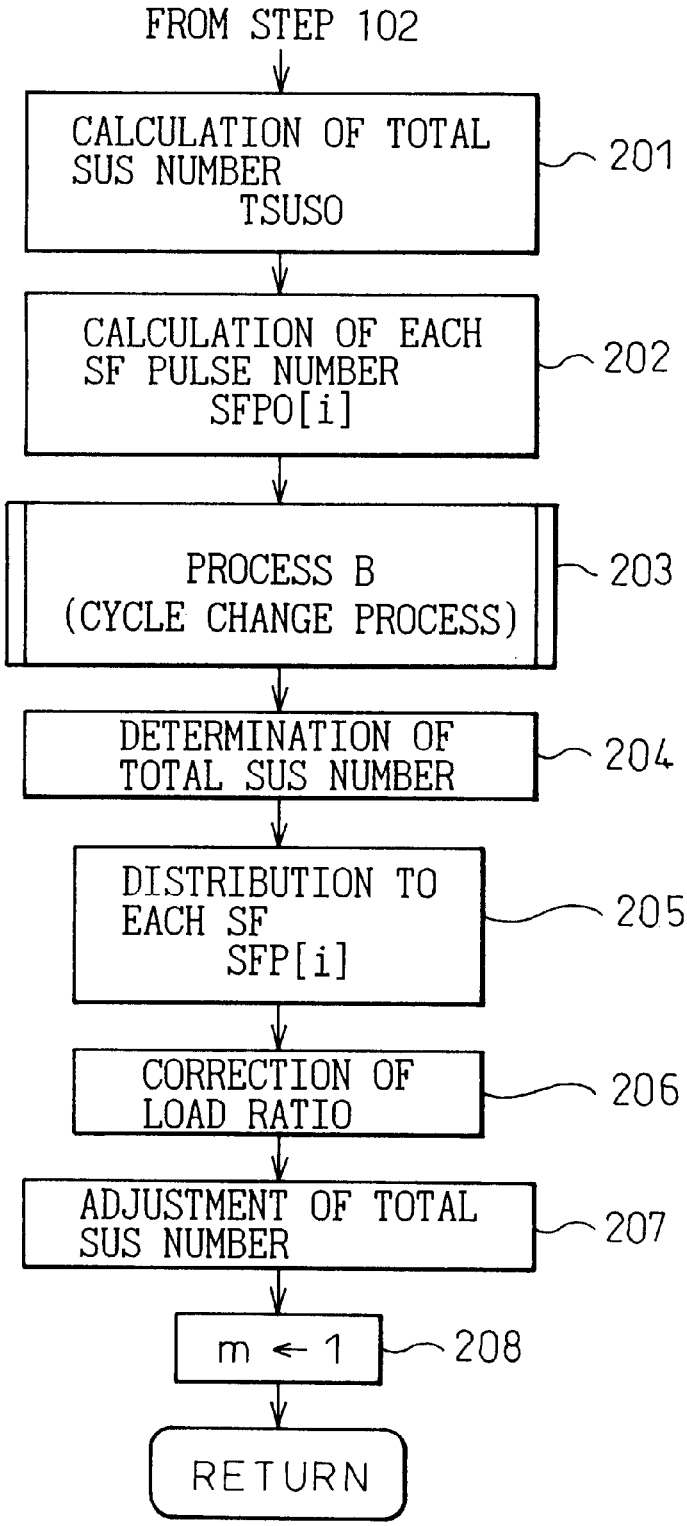
FIG. 10 is a flow chart that shows the process in the fourth embodiment.

FIG. 10 is a flow chart of the process 1 in the fourth embodiment.

As shown in FIG. 10, in the process 1 in the fourth embodiment, the process as far as step 102 is the same as that in the first embodiment. Next, in step 201, a total sustain number TSUS0 is determined temporarily from the calculated weighted average load, with the power consumption being taken into account. In step 202, a sustain pulse number SFP0 [i] of each subfield is calculated from the total sustain pulse number TSUS0 according to the luminance ratio of the subfield.

Next in step 203, the process B in which the sustain cycle of each subfield is changed is carried out. The processes of the following steps 204 to 208 are the same as those of the steps 105 to 109 in the first embodiment.

Figure 11:
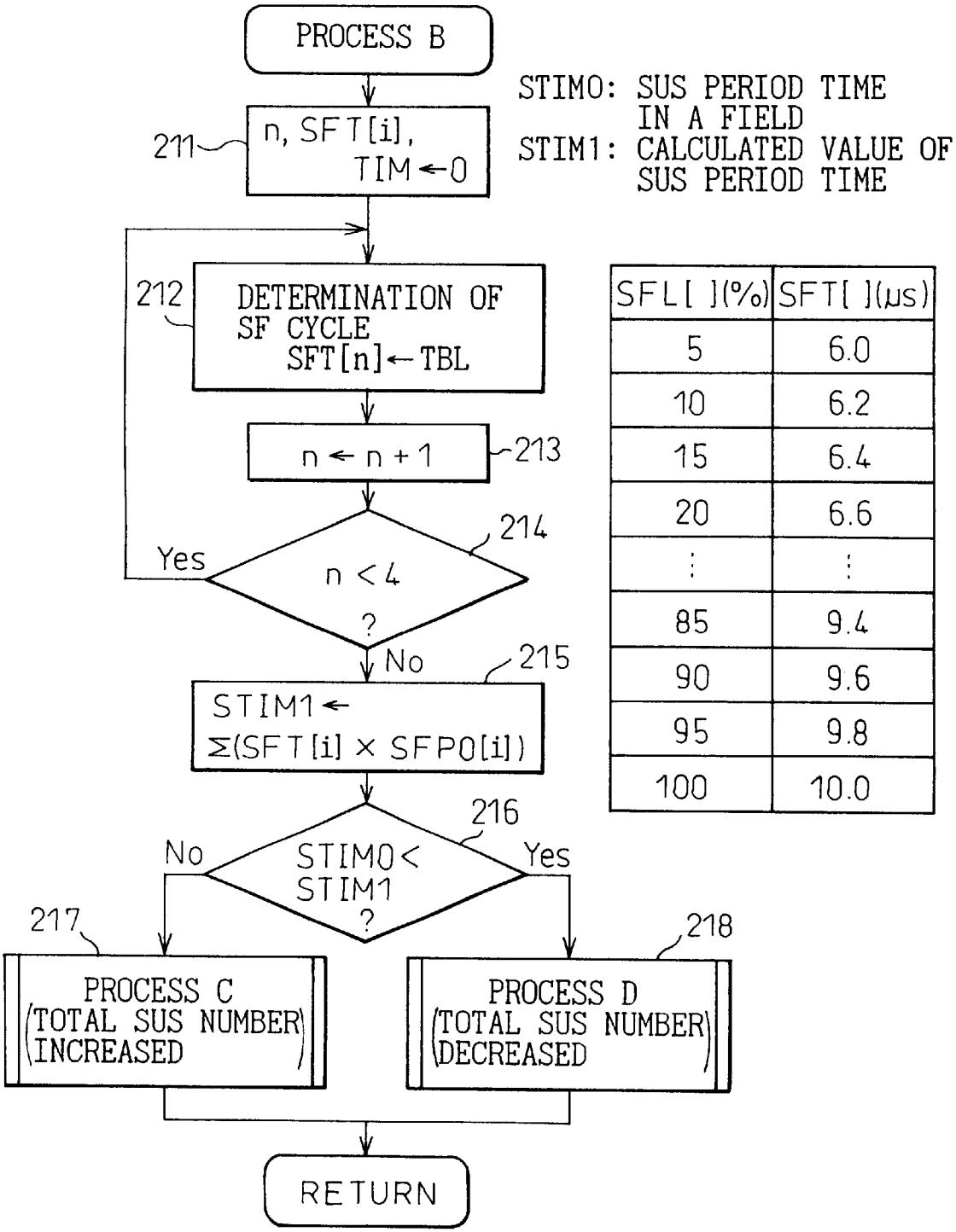
FIG. 11 is a flow chart that shows the process in the fourth embodiment.

FIG. 11 is a flow chart that shows the process B performed in the process 1. In the process B, n, the sustain cycle SFT [i] of each SF, and the vacant time TIM are initialized to zero in step 211. In step 212, the sustain cycle SFT [n] of each SF that corresponds to the load ratio SFL [n] of each SF is determined temporarily based on a table shown in FIG. 11. The table is provided to the sustain cycle change circuit 26. By further performing steps 213 and 214, the process is repeated for every SF.

In step 215, a total time STIM1 of the sustain period in a field is calculated by multiplying the sustain cycle SFT [i] of each SF determined as above by the sustain pulse number SFP [i] of each SF. In step 216, it is judged whether STIM1 exceeds the maximum value STIM0 of the total time of the sustain period in a field. If it does not exceed it, it is possible to increase the total number of sustain pulses, therefore, the process C in which the total number of sustain pulses is increased is carried out in step 217, and if it exceeds it, the process D is performed, in which the total number of sustain pulses is decreased in step 218, because it is necessary to decrease the total number of sustain pulses.

In the above-mentioned table, desirable sustain cycles in accordance with the load ratio are listed, and the sustain cycle is shortened when the load ratio is small and lengthened as it becomes large.

Figure 12:
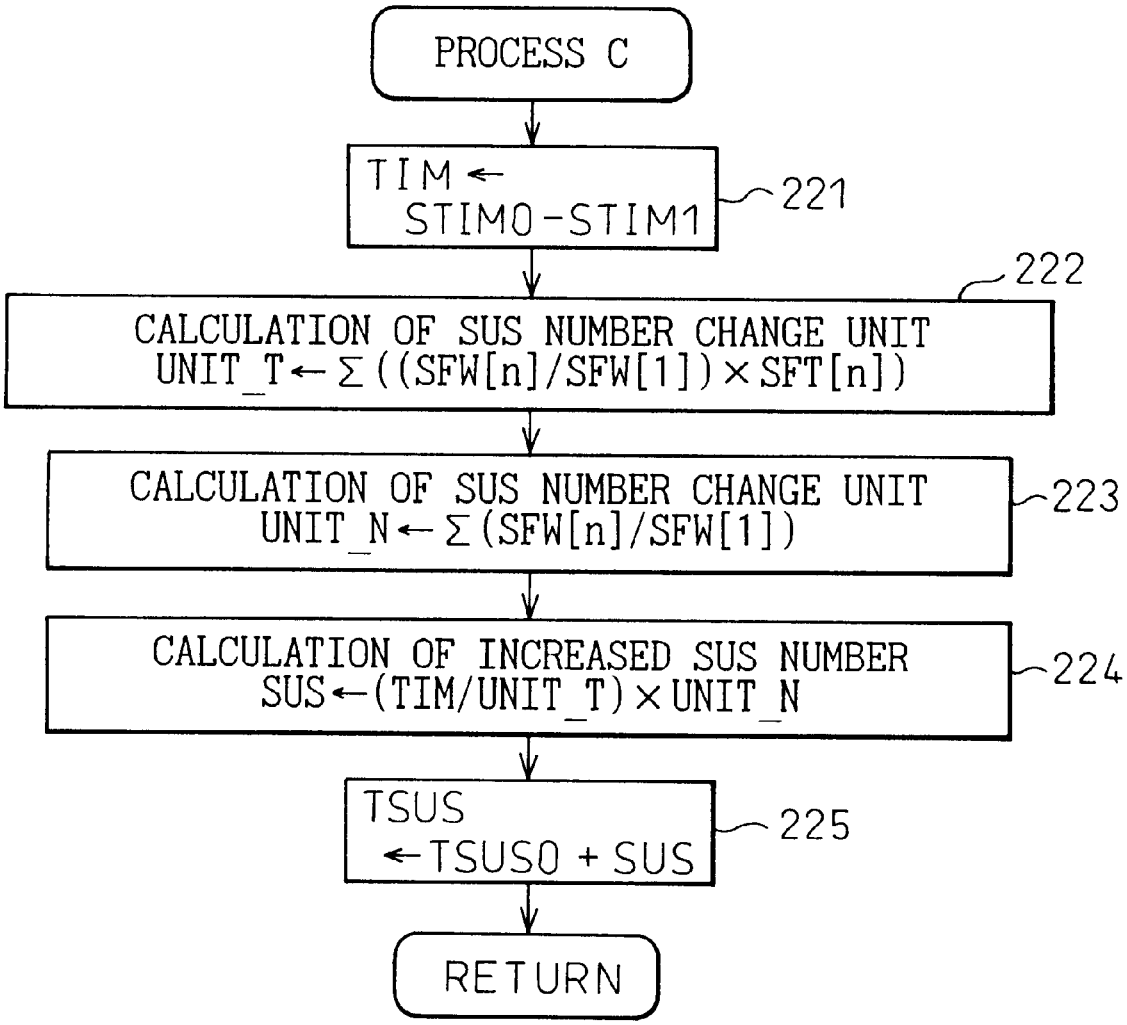
FIG. 12 is a flow chart that shows the process in the fourth embodiment.

FIG. 12 is a flow chart that shows the process C. In step 221, the difference STIM0–STIM1 between STIM0 and STIM1, described above, are entered into the vacant time TIM. Next in step 222, a unit time UNIT_T to be used when the sustain frequency is changed is calculated by multiplying the luminance ratio of each SF by the sustain cycle SFT [i] of each SF, with the first subfield SF [1] being the reference. In step 223, a unit sustain pulse number UNIT_N to be used when the sustain frequency is changed is calculated by dividing the luminance ratio SFW [n] of each SF by the luminance ratio SFW [1] of the first subfield and summing them.

It is necessary to increase the number of sustain pulses for each SF in accordance with the luminance ratio, that is, for example, if a sustain pulse is increased in SF [1], two sustain pulses need to be increased in SF [2] in order to maintain the luminance ratio. When a sustain pulse is increased in SF [1], therefore, it is necessary to increase the number of sustain pulses by UNIT_N in the entire frame in order to maintain the luminance ratio. That is, UNIT_N is the unit number when the number of sustain pulses is changed. In this case, it is also necessary to increase the sustain time by UNIT_N in the entire frame. That is, UNIT_T is the unit time required to increase the number of sustain pulses while maintaining the luminance ratio in a field.

In step 224, the vacant time TIM is divided by UNIT_T and how many UNIT_Ts can exist is calculated. Namely, the number of UNIT_Ns which can be increased is calculated. In this case, the fractional part is rounded down. Then, the number of sustain pulses SUS to be increased is calculated by multiplying the calculated result by the calculated number of UNIT_Ns. In step 225, the number of increased sustain pulses TSUS after is calculated by adding SUS to TSUS0 calculated in step 201 in FIG. 10.

The total number of sustain pulses is increased as described above.

Figure 13:
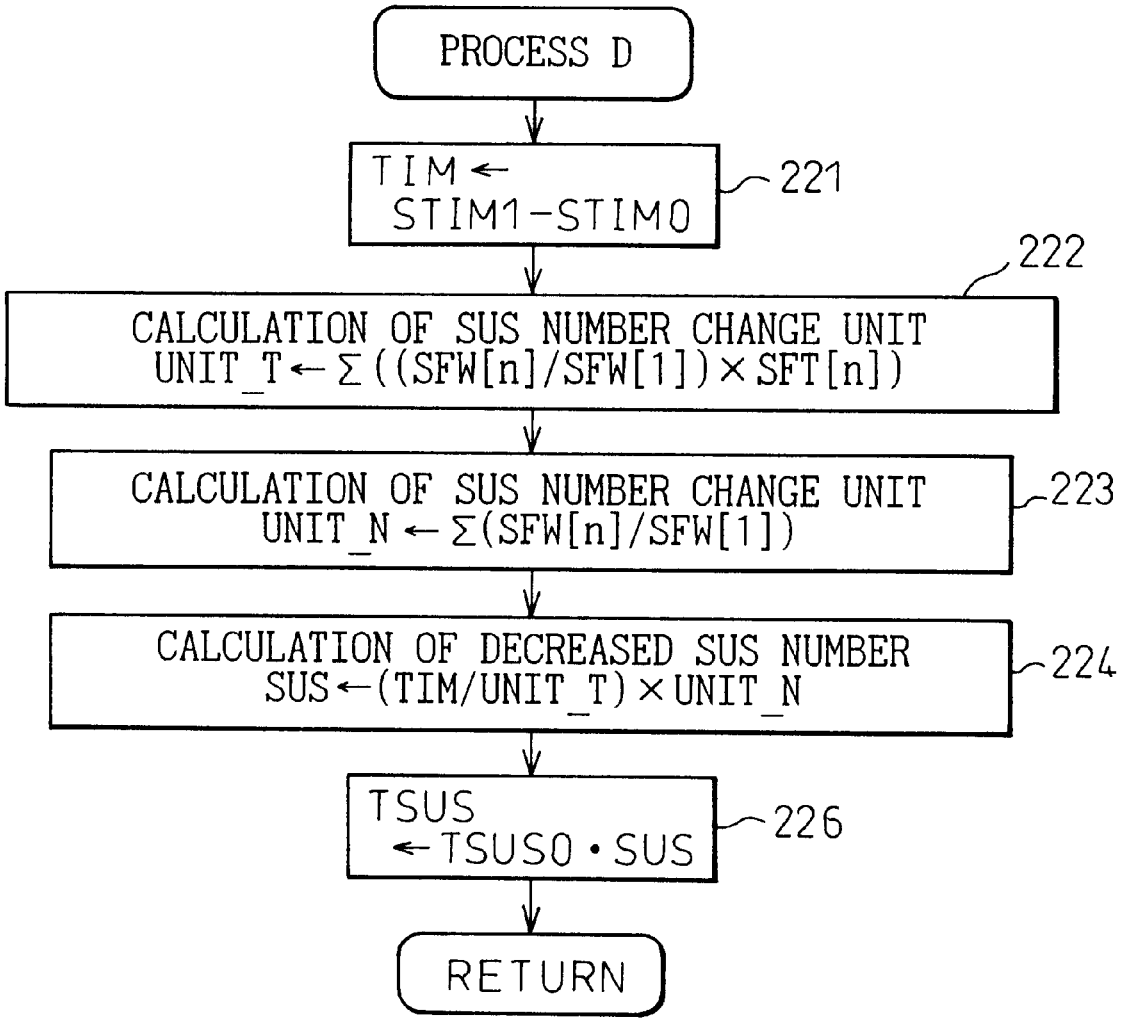
FIG. 13 is a flow chart that shows the process in the fourth embodiment.

FIG. 13 is a flow chart that shows the process D. As is obvious by comparison with FIG. 12, it differs from the process C only in that step 226 is carried out instead of step 225, and the other steps are the same. In step 226, SUS is subtracted from TSUS0 in order to decrease the number of sustain pulses.

Figure 14:
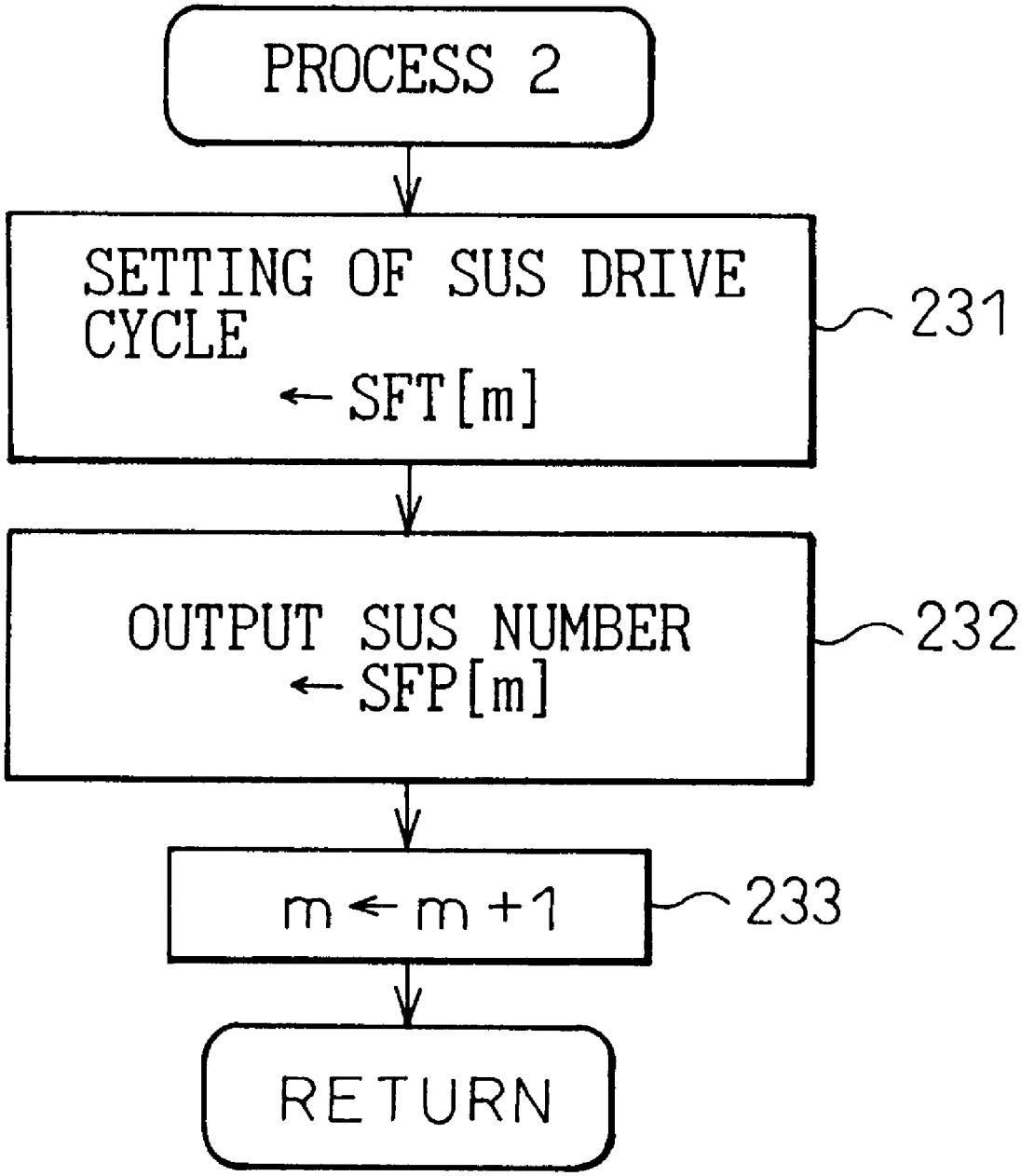
FIG. 14 is a flow chart that shows the process in the fourth embodiment.

FIG. 14 is a flow chart that shows the process 2 carried out in the fourth embodiment. In step 231, a sustain pulse drive cycle SFT [m] is set for each (mth) subfield. In step 232, the number of output sustain pulses SFP [m] of each subfield is set. The sustain action of the mth subfield is carried out according to SFT [m] and SFP [m] set in the above-mentioned manner. Then, m is increased by one in step 233 and the sustain action in the (m+1)th subfield is carried out by repeating steps 231 and 232.

Figure 1:
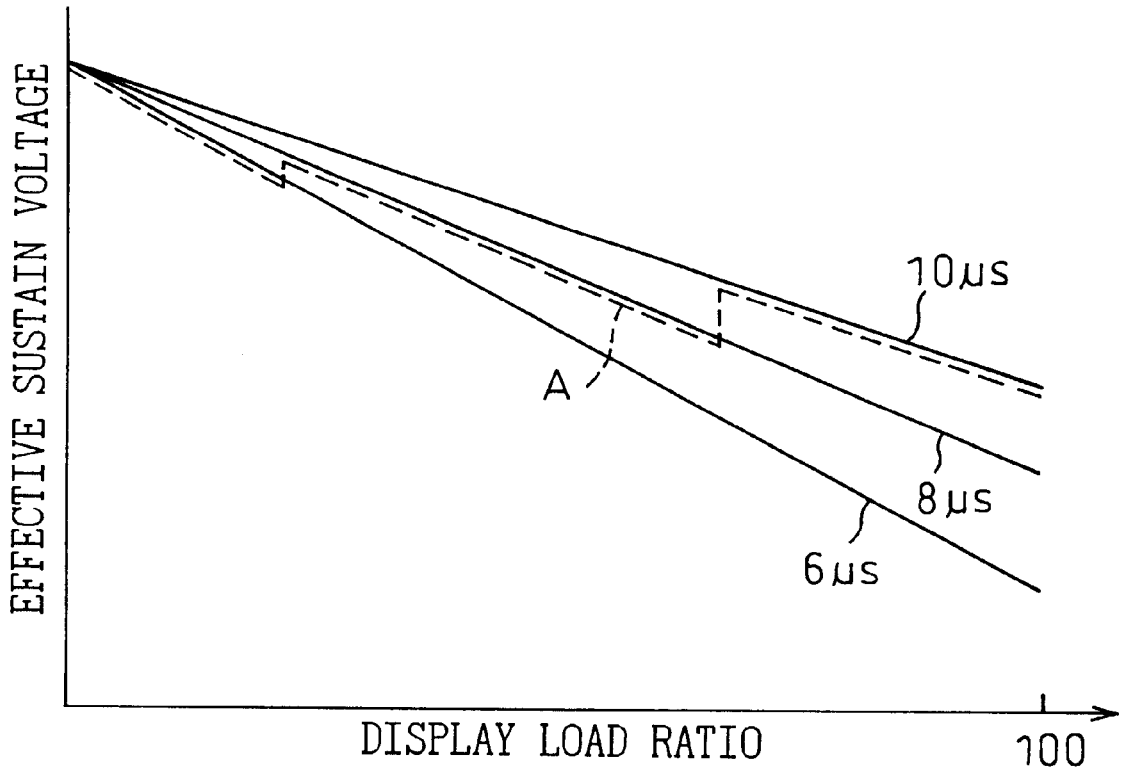
FIG. 1 is a diagram that illustrates the relationship between the display load ratio and the effective sustain voltage according to the sustain pulse cycle.
Figure 2:
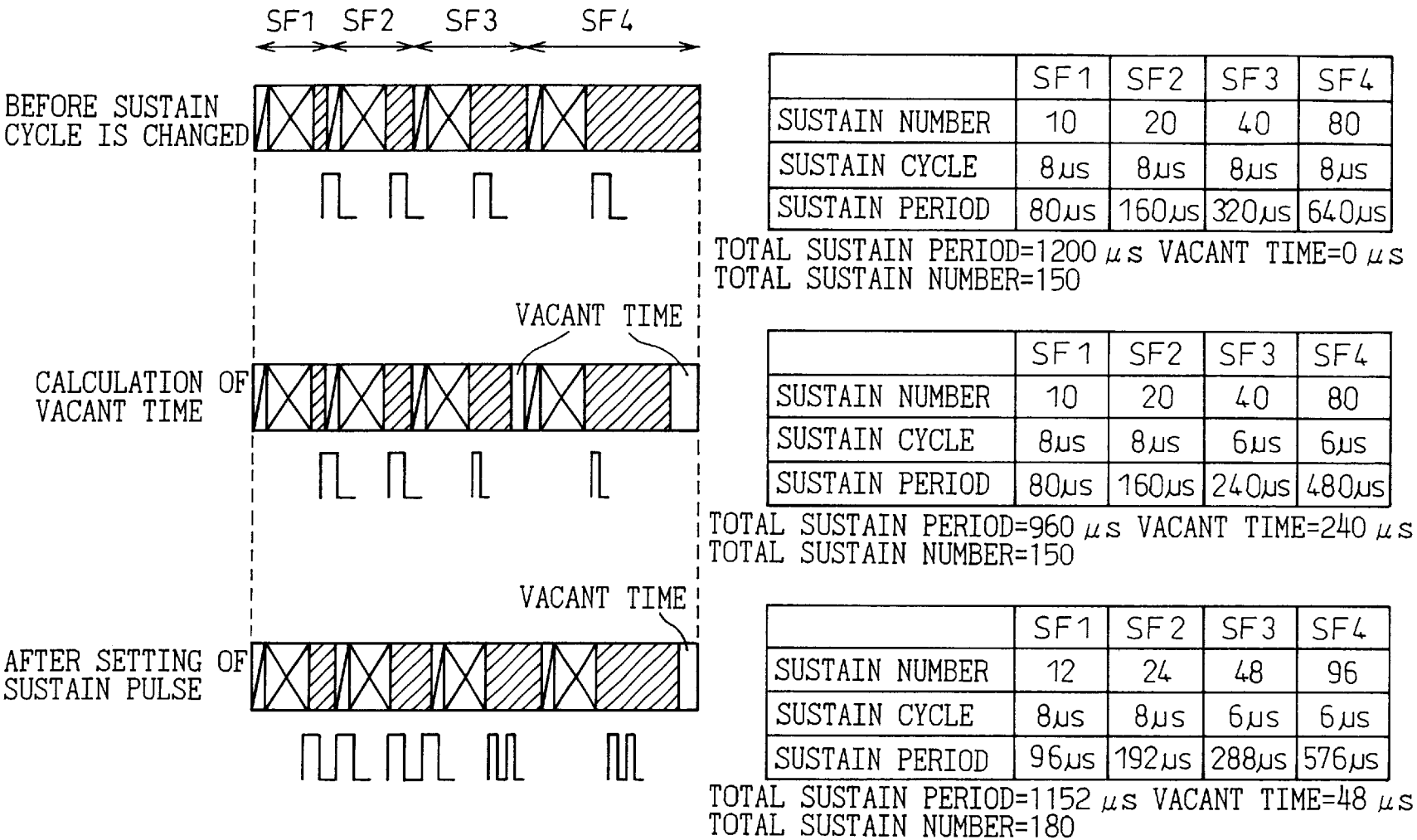
FIG. 2 is a diagram that illustrates the principles of the present invention.
Figure 15:
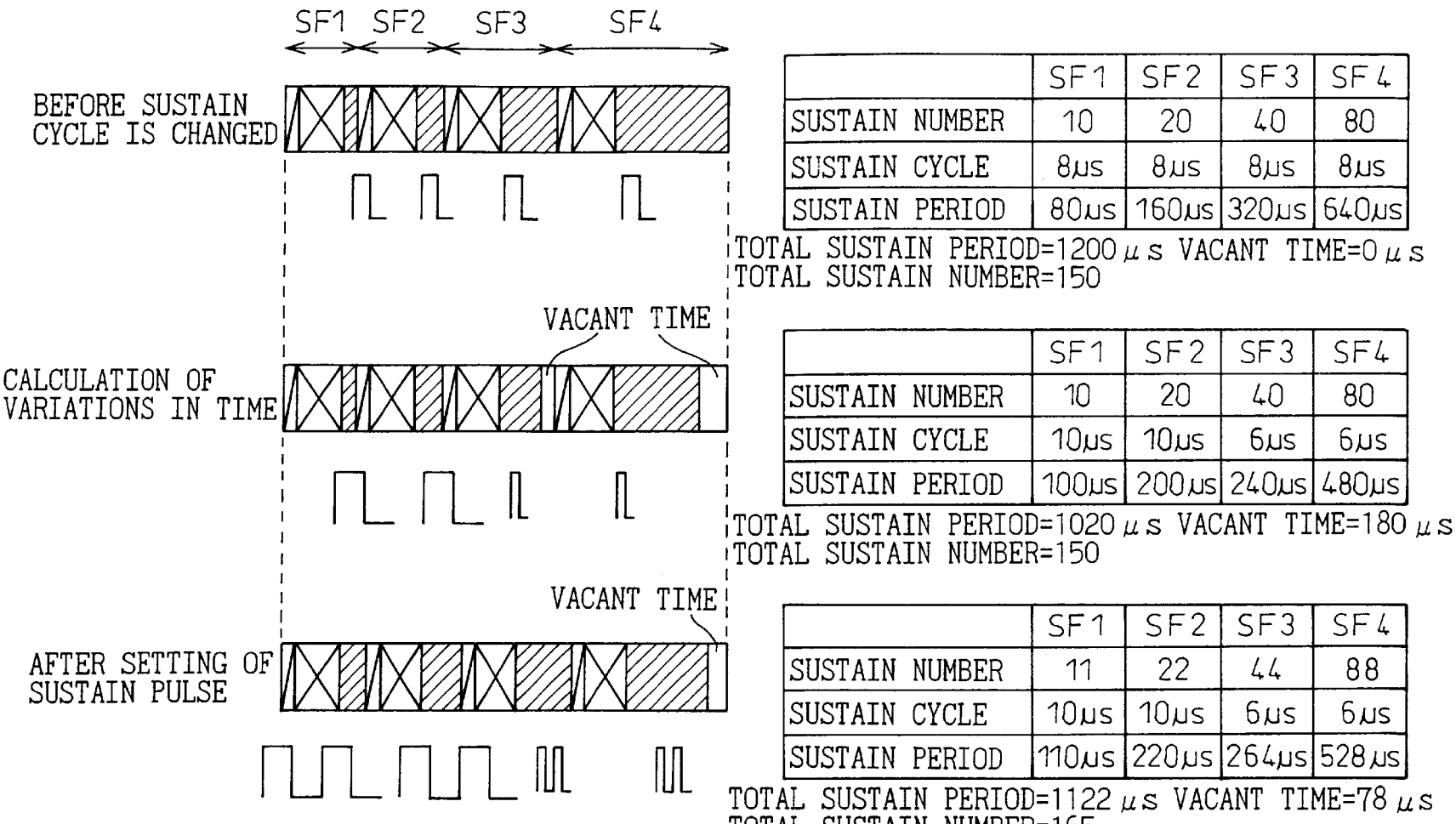
FIG. 15 is a diagram that shows an example of the results when the process in the fourth embodiment is applied.

FIG. 15 is a diagram that shows an example of the process results in the fourth embodiment, corresponding to FIG. 2. As shown schematically, before the sustain cycle is changed, all the sustain cycles of SF1–SF4 are 8 $\mu$S, the total of the sustain periods of SF1–SF4 is 1200 $\mu$S, and the total number of sustain pulses is 150. Since the display ratio of SF1 and SF2 is large, it is necessary to lengthen the sustain cycles of SF1 and SF2, but the load ratio of SF3 and SF4 is small, therefore, the sustain cycles of them can be shortened rather than lengthened.

An example is described in which the process in the fourth embodiment is applied to the above-mentioned case. It is assumed that the sustain cycle is expanded to 10 $\mu$S in SF1 and SF2 and that is shortened to 6 $\mu$S in SF3 and SF4. As a result, the sustain period of SF1 is increased by 20 $\mu$S from 80 $\mu$S to 100 $\mu$S, that of SF2 is increased by 40 $\mu$S from 160 $\mu$S to 200 $\mu$S, that of SF3 is decreased by 80 $\mu$S, that of SF4 is decreased by 160 $\mu$S, and the sustain period is decreased by 180 $\mu$S in the entire frame, resulting in the generation of a vacant time.

If the number of sustain pulses is increased by one in SF1, those of SF2 to SF4 need to be accordingly increased by 2, 4, 8, respectively, and the required unit time is $1\times10$ $\mu$S$+2\times10$ $\mu$S$+4\times6$ $\mu$S$+8\times6$ $\mu$S$=102$ $\mu$S. The vacant time is 180 $\mu$S, as described above, therefore, it is possible to increase the number of sustain pulses by one unit, and the numbers of sustain pulses of SF1 to SF4 become 11, 22, 44, 88, respectively, while the vacant time is 78 $\mu$S. As a result, degradation in image quality such as missing display points does not occur because it is possible to increase the number of sustain pulses by 10% compared to the original state and to set the sustain period of each subfield more properly. Although the sustain cycle is changed from 8 $\mu$S to 6 $\mu$S or to 10 $\mu$S in this example, it is also possible to change the cycle to a more proper one using the table shown in FIG. 11.

As described above, the case where the sustain cycles of part of the subfields are shortened and the rest are maintained in other subfields is described in the first embodiment, and the case where the sustain cycles of part of subfields are shortened and the rest are expanded in other subfields is described in the fourth embodiment, but it is also possible to expand the sustain cycles of part or all the subfields and maintain those in other subfields. This is effective in the cases such as where the power is controlled so that the total number of sustain pulses is decreased and the vacant time is generated.

As described above, according to the present invention, a PDP apparatus can be realized in which degradation in image quality such as missing display points does not occur even though the peak luminance is increased.

We claim:

1. A plasma display apparatus, that performs the gradated display using the subfield method, comprising:

a plasma display panel having plural scan electrodes and sustain electrodes that extend in a same direction and are arranged adjacent to each other and plural address electrodes that extend in a direction perpendicular to that of the plural scan electrodes and the sustain electrodes;

a sustain pulse cycle change means for detecting the display load ratio of each subfield and changing the sustain pulse cycle of each subfield according to the detected display load ratio; and an adaptive sustain pulse number change means for:

calculating variations in time in a display field caused by changes in the sustain pulse cycles, and increasing/decreasing the number of sustain pulses of each subfield according to the total amount of variations in time.

2. A plasma display apparatus, as set forth in claim 1, wherein the adaptive sustain pulse number change means increases/decreases the number of sustain pulses thereby to maintain a predetermined luminance ratio of each subfield.

3. A plasma display apparatus, as set forth in claim 1, further comprising;

an adaptive luminance correcting means for correcting the change in luminance due to the change in the sustain pulse cycle of each subfield; and the adaptive sustain pulse number change means increases/decreases the number of sustain pulses of each subfield according to the corrected change in luminance of the adaptive luminance correcting means.

4. A plasma display apparatus, as set forth in claim 1, wherein the adaptive sustain pulse number change means increases/decreases the number of sustain pulses of each subfield according to the display load ratio of each subfield.

5. A plasma display apparatus, as set forth in claim 1, wherein the sustain pulse cycle change means shortens the sustain pulse cycle of each subfield when the display load ratio of the subfield is less than a specified value and expands same when the display load ratio greater than the specified value.

6. A plasma display apparatus, as set forth in claim 1, wherein the sustain pulse cycle change means changes the sustain pulse cycles of a part of the subfields that includes a subfield with the maximum luminance or of all the subfields.

7. A plasma display apparatus, as set forth in claim 1, wherein the sustain pulse cycle change means changes the sustain pulse cycle from that at an inception of changing to a target change value, so as to change, step by step, across plural fields.

8. A plasma display apparatus, as set forth in claim 1, wherein the adaptive sustain pulse number change means changes the number of sustain pulses in accordance with the changes in sustain pulse cycles so as to change, step by step, across plural fields.

9. A plasma display apparatus, as set forth in claim 1, wherein the sustain pulse cycle change means changes the sustain pulse cycles of all the subfields to the same cycle when the display load ratio of all the subfields, or of subfields with a luminance ratio which is greater than a specified value, is less than a specified value.

10. A plasma display apparatus, as set forth in claim 1, wherein the adaptive sustain pulse number change means changes the number of sustain pulses of a part of the subfields, that includes a subfield with a maximum luminance or of all the subfields.

* * * * *

UNITED STATES PATENT AND TRADEMARK OFFICE

CERTIFICATE OF CORRECTION

PATENT NO. : 6,686,698 B2 
DATED : February 3, 2004
INVENTOR(S) : Masanori Takeuchi et al.

It is certified that error appears in the above-identified patent and that said Letters Patent is hereby corrected as shown below:

Drawings
Fig. 6, block 121, after "SUS8" insert -- , --.
Fig. 13, block 226, change "·" to -- - --.

Column 10,
Lines 20 and 21, change "the" to -- a --.
Line 44, change ";" to -- : --.
Line 60, after "ratio" insert -- is --.

Signed and Sealed this

Eighth Day of June, 2004

JON W. DUDAS
*Acting Director of the United States Patent and Trademark Office*